US005584665A

United States Patent [19]

Walsh et al.

[11] Patent Number: 5,584,665

[45] Date of Patent: Dec. 17, 1996

[54] LIQUID DRAINAGE SYSTEM WITH PNEUMATIC SENSOR

[76] Inventors: Roger C. Walsh, c/o P.O. Box 1055, Corourg, Ont., Canada, K9A-4W5; Douglas W. Eggins, 17 Robert Street, Thornton, Ont., Canada, L0L 2M0

[21] Appl. No.: 304,930

[22] Filed: Sep. 13, 1994

[51] Int. Cl.[6] ..... F04B 49/00

[52] U.S. Cl. ..... 417/29; 417/40; 137/236.1; 285/238

[58] Field of Search ..... 417/28, 29–31, 417/36, 40; 251/5; 137/59, 236.1; 285/253, 238, 245–7

[56] References Cited

U.S. PATENT DOCUMENTS

| | | | |
|---|---|---|---|
| 1,684,713 | 5/1929 | Norgren | 285/245 |
| 2,339,957 | 1/1944 | Smith | 417/29 |
| 2,787,220 | 4/1957 | Patterson et al. | 417/29 |
| 3,133,501 | 5/1964 | Brady | 417/29 |
| 3,814,466 | 6/1974 | Leopold, Jr. | 285/245 |
| 4,344,741 | 8/1982 | Taki | 417/29 |
| 4,437,689 | 3/1984 | Goebel et al. | 285/246 |
| 4,456,024 | 6/1984 | Roberts | 137/62 |
| 4,664,143 | 5/1987 | Thompson | 417/28 |
| 4,784,173 | 11/1988 | Carney | 137/2 |
| 4,848,389 | 7/1989 | Pirkle | 137/80 |
| 4,887,847 | 12/1989 | Barnoach | 285/247 |
| 4,951,976 | 8/1990 | Boelkins | 285/247 |
| 5,113,892 | 5/1992 | Hull et al. | 137/62 |

*Primary Examiner*—Timothy S. Thorpe
*Assistant Examiner*—Xuan M. Thai
*Attorney, Agent, or Firm*—D. W. Eggins

[57] ABSTRACT

In a frost-free water supply system that drains down to avoid freezing, during non-pumping periods, operation of the system is responsive to pressure changes within the system. A pneumatic relay sensitive to changes in one of the fluid pressures operative in the system is located in a portion of the system subject both to water pressure and to the air pressure operating in the system, to provide a pneumatic signal that activates or de-activates one or more system components. One arrangement has a water line discharging into an animal watering bowl within a protected environment. The pneumatic relay is in pressure sensing relation with a localized portion of the water line that remains undrained when the major length of the hose is drained. The pneumatic relay subsequently senses a drop in water pressure, responsive to the re-filling of the bowl. The pneumatic relay is connected to a distant relay, to switch on the pump and recharge the water line, to re-supply the bowl. The relay also may control other system functions, such as reacting to a sharp local rise (or "bump") in pneumatic pressure that occurs in the system at the moment of closure of a float valve, to actuate a relay operating the water line drain valve, or even to switch off the pump. In another embodiment, a low voltage electric float switch located in a water bowl may be used to actuate a master solenoid, to switch on the water supply. A series of such bowls, each with its own float switch may be used, to achieve individual water supply to each bowl from a common, air-charged, frost-free water supply line. This arrangement generally would have line drain valves, to ensure line drainage and an absence of freze-up potential in the line segments between the bowls.

19 Claims, 5 Drawing Sheets

LIQUID DRAINAGE SYSTEM WITH PNEUMATIC SENSOR

TECHNICAL FIELD

This invention is directed to a pneumatic pressure responsive module, and in particular to a module for use with a so-called "frost free" water supply system, and associated components.

BACKGROUND ART

The weather-proofing of water systems to prevent freeze-up and associated damage has been the focus of many patents. However the search for reliable, low-cost systems still proceeds in view of the defects, drawbacks and high installed and operating costs of the systems presently available The present invention is closely associated with the invention previously disclosed in pending U.S. application, Ser. No. 08/209,981 filed Mar. 11, 1994, of which I am a co-inventor. That prior invention is closely associated with the subject matter found in Canadian Patent No. 1,122,877 Gauthier, May 1971.

One of the drawbacks of the earlier Gauthier and other prior systems has been the absence of a reliable, low cost weather-proof (ie. freeze-insensitive or "frost-free") control system.

Most free-standing water systems are depemdent upon the system water pressure to actuate a pressure-sensitive switch, in order to control the on-off actuation of the pump.

In the operation of the frost-free systems disclosed in the above referred to pending application, where the control of the system is located within the protected environment of the system pump, external freezing conditions do not influence the control function.

In situations where a remote location is served by an exposed pipeline that is subject to freezing the water transmitting portion of the pipeline cannot be utilized to serve as a pressure transmitter or as a signal transmitting agent as the occurrence of line freezing disables the line in both those required functions, and in a de-watered condition the line is incapable of transferring pressure signals.

DISCLOSURE OF INVENTION

The present invention provides a pneumatic sensing and relay system to control one or more of the functions of the system.

In a first embodiment having a pipeline for providing liquid to a remote utilization zone there is provided a pressure responsive system having a resilient-walled passage for the transfer of liquid therethrough; valve means for controlling the egress of liquid from the passage; check valve means to limit the return-flow of the liquid within a portion of the passage; substantially sealed fluid container means adjacent the passage having a wall portion thereof in adjoining, pressure transfer relation with the pipeline, in use to contain a fluid under pressure therein; the instantaneous pressure of fluid within the container varying in response to changes in the pressure of the liquid within the adjoining pipeline portion.

The changes occurring in the pressure of fluid within the container may be used to control the operation of a pump supplying liquid to the system. The preferred sensing fluid is air, ie. a pneumatic system.

The occurrence of the sudden termination of liquid flow within the pipeline, such as by the snap-action of a float valve at the line outlet, can produce a sudden "bump" in the pressure sensed by the pneumatic sensor. This "bump" in sensed pressure may be utilized to shut down the pump; it may also be used with another pressure responsive servo to actuate a water-line drain valve.

It will be understood that, unlike a water pumping system having a pressure tank with a pressure sensitive control switch to control both pump starting and cut-out, in response to the pressure prevailing within the tank, the aforesaid, presently disclosed system can operate a pump connected directly to the pipeline, without the need for a pressure tank and its associated controls.

In a further embodiment of the invention the aforesaid sealed container is connected to a source of fluid, including means for admitting pressure fluid thereto to deform the pressure transfer wall portion into blocking relation with the liquid transfer pipeline, such that the pneumatic device may serve as a shut-off valve.

In one embodiment employing the pneumatic sensor in a shut-off valve function, the system may have a gravity feed water inlet serving a domestic pressurized system, where the domestic pressure is provided by a pump within the house, to which the gravity fed water line is connected. A pneumatic pressure line from the top of the system pressure tank leads to the pipeline inlet at the source, generally at the top of an adjoining hill. There, a pneumatic relay connected with the pneumatic pressure line, operating in response to the achievement of a predetermined pressure within the pressure tank, operates the solenoid valve to admit pressurized air to the pneumatic shut-off valve, causing it to close-off the line. The pump may be timed to operate for a further short time period, to pump the line contents into the system, and so empty the line. The system may include the provision of an air bleed valve, to admit air into the line and thus facilitate the emptying of the water line.

The pneumatic shut-off valve may further comprise a slide valve containing a valve spool, to control the on/off flow of water in the system. This valve may be connected directly with a pressurized pneumatic portion of the system, so as to cut-off or initiate water flow in response to local changes in the system air pressure. One type of pneumatic energizer for controlling the operation of a frost-free water supply may comprise a water utilization container such as an animal drinking trough, wherein changes in the weight of the container contents, being representative of a demand for water, are used to vary the compression of an air bladder-pump, connected in controlling relation with the system. This air pressure control may be used to control the operation of a water pump, or the operation of a flow control valve, such as a water supply spool valve.

In operating a frost-free water supply system, one of the problems that has been encountered is that of water-lock. This may occur in a system incorporating one or more drain-down valves, each having a light spring, operable to open a drain flap, once water pressure in the line reaches a sufficiently low value to permit the light spring of the valve to open the drain flap. Under water-lock conditions, the residual pressure in the pipeline when the pump shuts off is still too high for the drain-down valve to operate.

By incorporating a drip-valve into the line, having a built-in slow rate of drip at normal pumping pressure, and a somewhat faster rate of drip under the lower water pressure that exists after the termination of pumping, the residual pressure can dissipate at a more acceptable rate, permitting the drain-down valve to open and permit the line to discharge it water content, under the pressure of air acting on the pipeline, before freeze-up can take place.

Operation of any water installation at temperatures well below zero Fahrenheit (−18 Centigrade) requires rapid and reliable de-watering, once pumping and full flow are terminated, as otherwise the de-watering valve may itself freeze-up, thus exposing the remaining line contents to freze-up.

In operating frost-free systems wherein the water pipeline is compressed by air pressure applied by the system, advances have been made in ameliorating the tendency for the resilient water pipeline component to fail at its end fitting.

BRIEF DESCRIPTION OF THE DRAWINGS

Certain embodiments of the invention are described by way of illustration, without limiting of the invention thereto, other than as defined by the following claims, reference being made to the accompanying drawings, wherein;

DETAILED DESCRIPTION OF THE INVENTION

Figure 1:
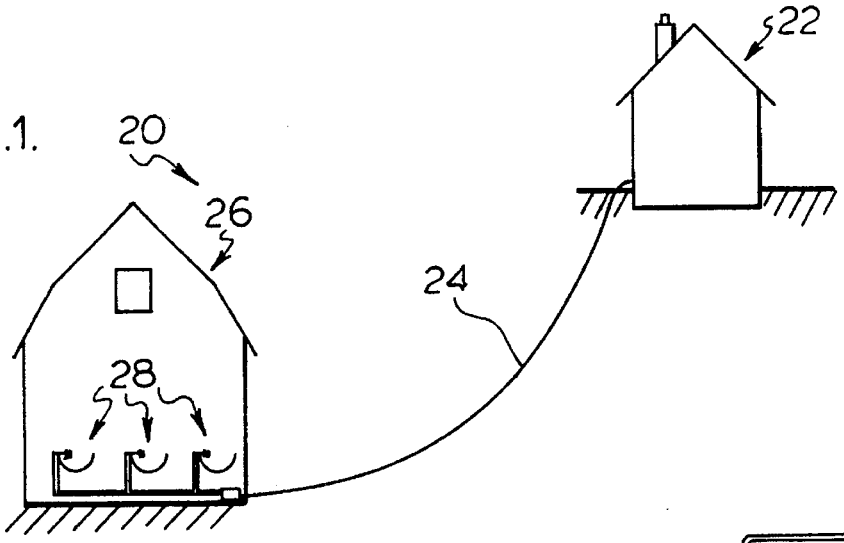
FIG. 1 is a schematic view of a frost-free, drainable water supply line from a house to a barn, incorporating a pneumatic control in accordance with the invention.

Referring to FIG. 1, the illustrated arrangement 20 comprises a house 22 having a de-waterable, composite frost free pipeline 24 connected to a barn 26. The barn 26 is illustrated as containing a number of cattle watering bowls 28.

Figure 2:
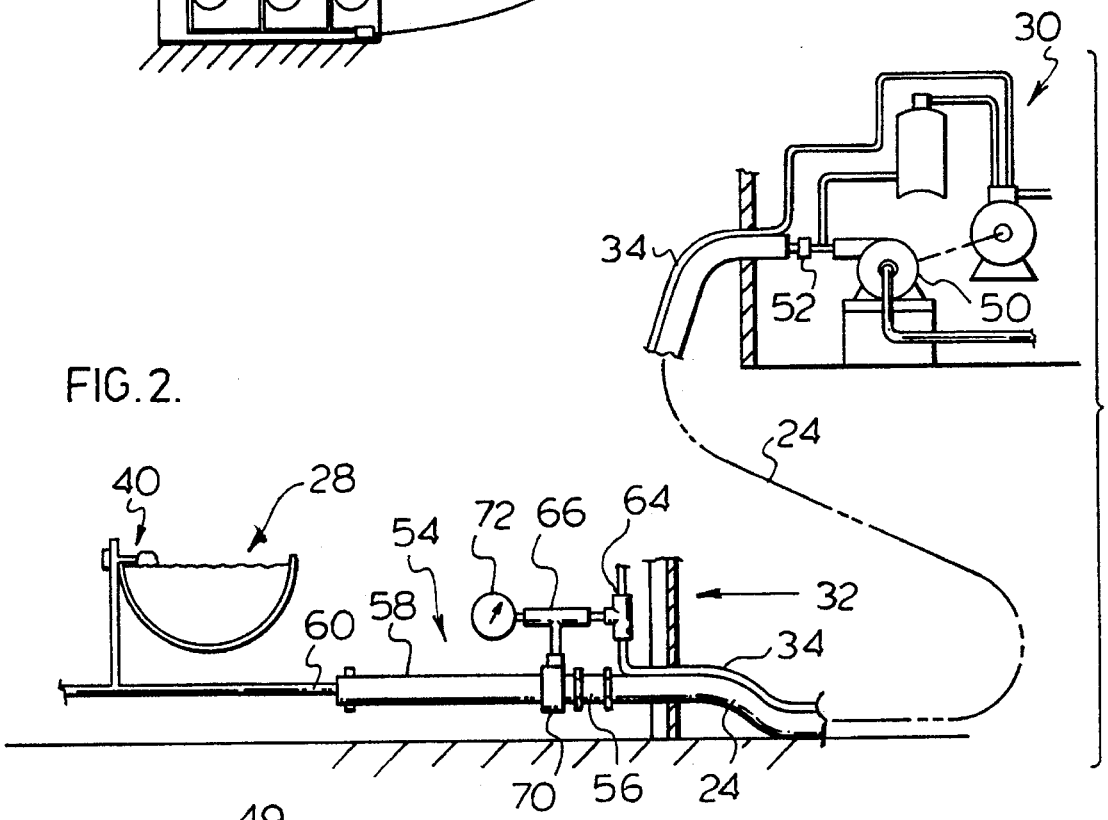
FIG. 2 is a schematic enlargement showing portion of the FIG. 1 arrangement.

Referring to FIG. 2, this shows the house internal plumbing arrangement 30 and barn internal plumbing arrangement 32. The composite, dewaterable frost-free pipeline 24 connects the house plumbing to the barn plumbing. The pipeline 24 may be laid on top of the ground or in a shallow trench, where it would normally be subject to a freezing environment. In addition to the pipeline 24 a pneumatic control line 34 also extends between house 22 and barn 26.

The pneumatic control line 34 may be integrated with and form a component part of pipeline 24, preferably by way of unitary extrusion. The pneumatic control line 34 may be of metal or suitable plastic.

Figure 9:
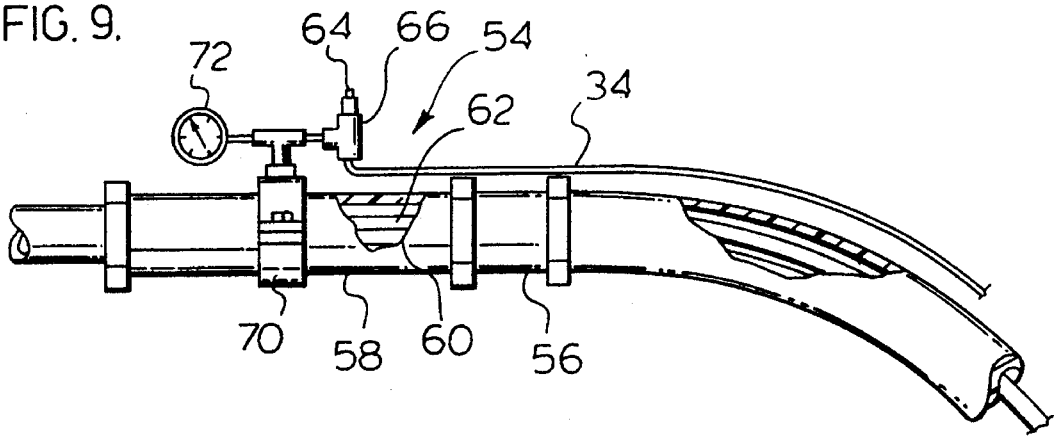
FIG. 9 is a side elevation, in part-section, of the pneumatic sensor shown in FIG. 1.

Referring more particularly to FIG. 2, and also in-part to FIG. 9, one of the watering bowls 28 is shown, supplied by water line 38. The bowl 28 has a float valve 40, by which the water level is maintained fairly constant.

Figure 3:
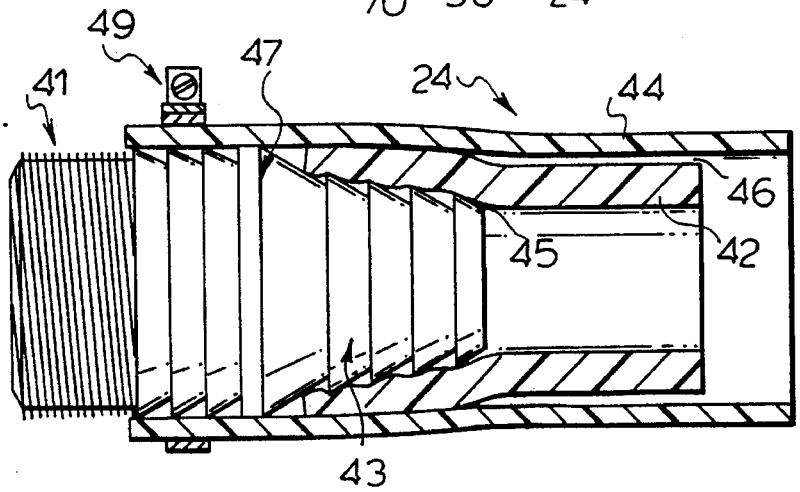
FIG. 3 is a diametrical section of an end fitting for a composite pipeline.

FIG. 3 shows a type of end fitting 41 by which the pipeline 24 may terminate, showing the collapsible inner hose 42 and surounding outer hose 44 that provides an annular air picket 46 about the hose portion 42. The air pocket 46 of pipeline 24 may contain a residual air charge sufficient to collapse the hose portion 42 when pumping by the pump 50 is terminated, and drain valve 52 in the house 22 is opened.

The end fitting 41 has a tapered inner end first portion of saw-toothed profile 43, and a relieved inner end nose portion 45 about which the inner hose 42 can fold, without undue stress or cutting.

An outer, second portion of fitting 41, being of larger diameter saw-toothed profile 47, receives the outer hose 44 in sealed, clamped relation thereon, by way of clamp 49. The fit of inner hose 42 upon the toothed profile 43 in sealing relation therewith is secured by the outer hose 44 in pressing relation thereabout.

Reverting to FIG. 2, the bowl 28 is supplied from the pipeline 24 by way of pneumatic sensor 54. A check-valve 56 separates the sensor 54 from the pipeline 24, such that, upon termination of pumping the pipeline 24 may be depressurized and emptied of its water, while the sensor 54 and the interior system of the barn is maintained in a water-filled and pressurized condition by check valve 56.

The sensor 54 (FIG. 9) has an outer cylindrical body 58, with an elastic walled inner passage 60 extending therethrough. A sealed annular air space 62 surrounds the inner passage 60, connection thereto being provided by a schrader-type air valve 64 mounted upon tee-connector 66 and connected at 68 to a perforated saddle 70 connecting through the wall of body 58 to the space 62. A gas-pressure gauge 72 is mounted upon the assembly; and a sensor connecting line 34 extends from the tee connector 66 thereof to the house system 30.

In the house, the operation of the pump is initiated by a significant drop in the air pressure in the line 34. This occurs when the level in the water bowl within the barn falls and the float valve 40 opens to supply water to the bowl. The resulting depletion of water within the sensor 54 causes an automatic fall in the air pressure within sensor 54, which pressure drop is sufficient to cause the pump control relay to energize the pump.

Figure 4:
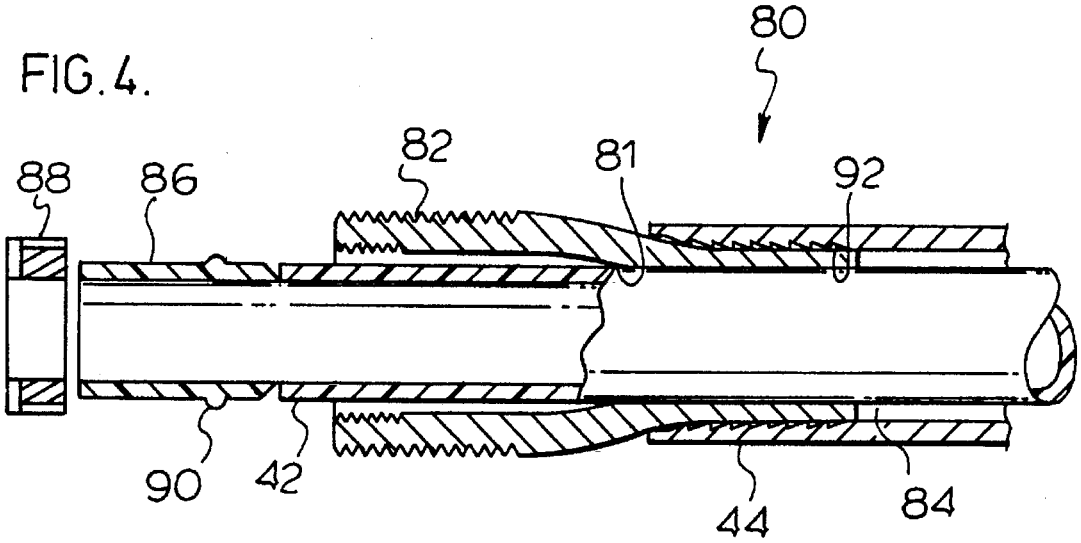
FIG. 4 is a view similar to FIG. 3, of another pipeline end-fitting embodiment.

Referring to FIG. 4, this end fitting 80 is illustrated as having a pipe-threaded outer end 82, for connection to a like-threaded female fitting. The fitting 80 is internally tapered at 81 such that an inner hose 42 can be inserted at the inner end 84 of the fitting, and a bushing 86 inserted into the end of hose 42. The hose 42 is then partially withdrawn, permitting the bushing 86 to enter the fitting 80. A hollow nut 88 can then be inserted within the threaded outer end of the fitting 80, and screwed home, so as to compress the bushing 86 into axial compressing relation with the hose 42. A compression ring portion 90 about the bushing 86 compresses the hose 42 in compressed sealing relation with the internal taper 81 of the fitting 80.

The outer surface of the inner (right-hand) end of fitting 80 has a saw-tooth profile 92, to sealingly engage the outer hose 44, which may be heat-shrunk thereto, or clamped in place.

Figure 5:
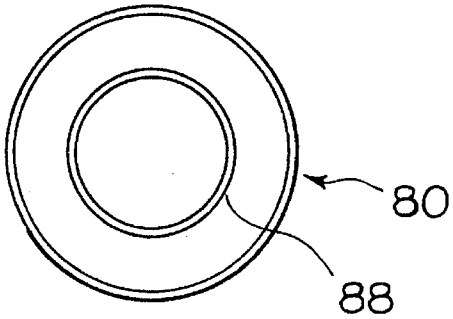
FIG. 5 is an end-view of the FIG. 4 embodiment.

FIG. 5 shows the end view of the assembled fitting 80, with the hollow nut 88 screwed into place.

Figure 6:
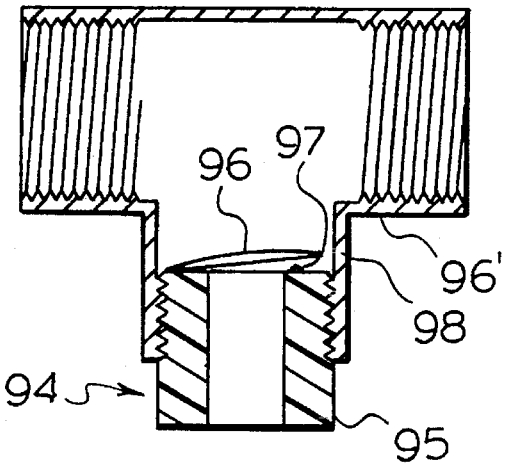
FIG. 6 is a diametrical cross-section of a Tee connector incorporating a drip valve.

FIG. 6 shows a drip-valve 94 in screwed-in, inserted relation within a T-piece 96'. The drip valve 94 has an elastomer body 95 and flap valve portion 96 permanently hinged thereto. A small spacer nib protrusion 97 on the seat 98 of the drip-valve 94 permits a permanent leak therepast, by preventing full engagement of the flap 96 with the seat 98 in total sealing relation. In use, under pumping conditions, the increased pressure deforms the flap portion 96 and semi-seals off the drip-valve, so that the drip-rate is low. When pumping ceases and the internal pressure diminishes, the flap regains its shape so that the rate of drip increases, to assist in reducing the internal water pressure to the point that the system drain valve or valves can come into play.

Figure 7:
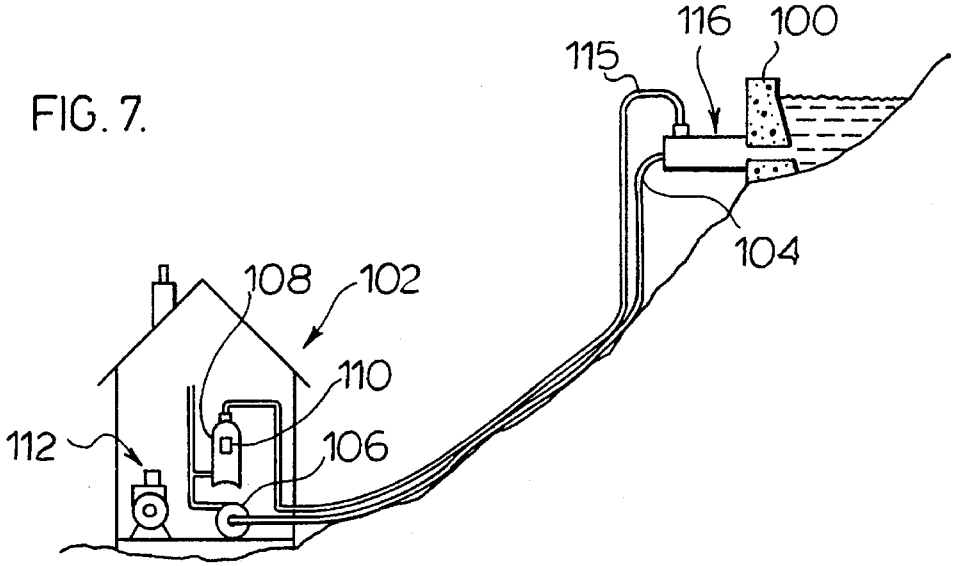
FIG. 7 is a schematic illustration, in partial section, showing a pneumatic shut-off on a gravity fed water supply system.
Figure 8:
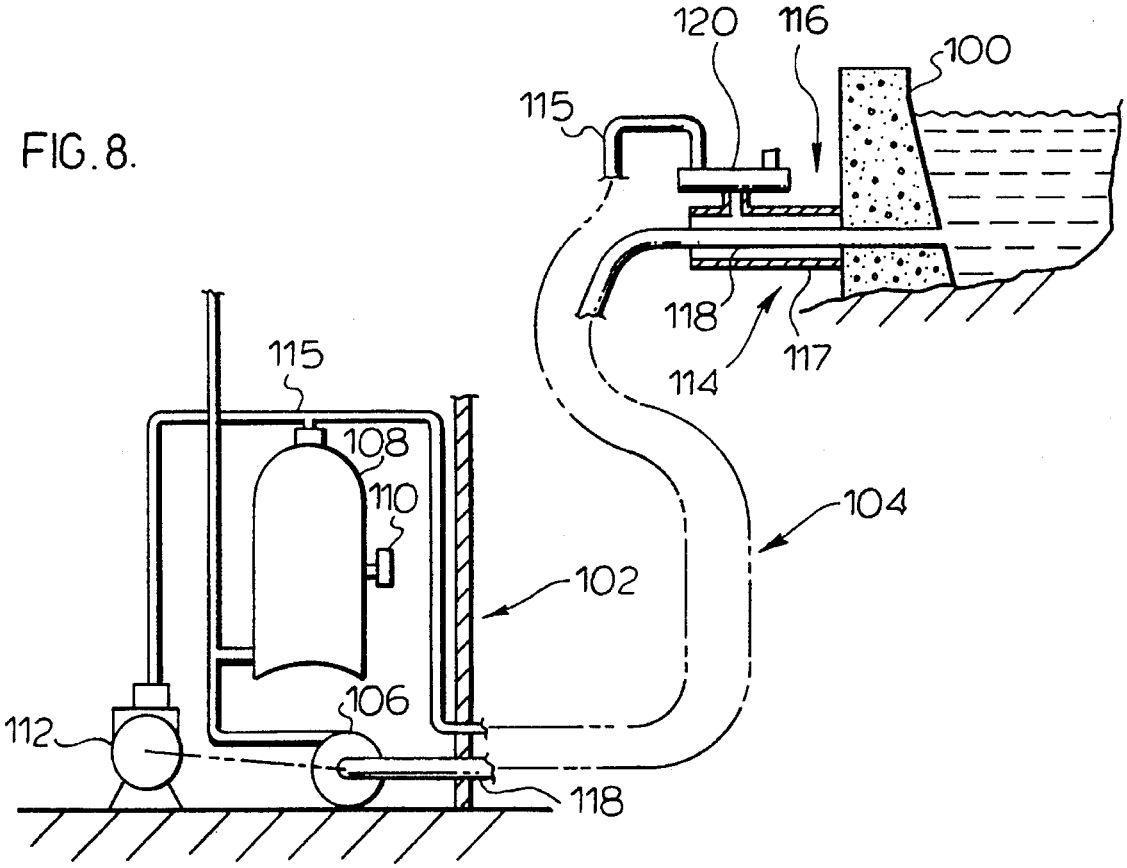
FIG. 8 is an enlargement of portions of the FIG. 7 arrangement.

Referring to FIGS. 7 and 8, the gravity-fed water supply from the dam 100 to the house 102 is by way of a pipeline 104. The pipeline 104 may be an air-charged dual hose pipeline, in which case the permanent air charge is at a low pressure.

Within the house a pump 106 receives water from the pipeline 104 and pumps it to a pressure tank 108. The tank 108 is equipped with an air recuperator valve 110, such as the patented Air Volume Control Valve of Brady Products Inc. of Clearwater, Fla. U.S. Pat. No. 2,744,543. The air-filled top of the tank 110 connects with the pressure-sensitive on/off relay of the electric motor 112, and also with the dam outlet 114, by way of line 115.

At the dam an air pressure controlled, air-actuated shut off valve 116 is located, to which the air line 115 connects.

The shut-off valve 116 consists of an outer casing 117 which may comprise a hose through which a compressible water hose 118 extends. A spring-loaded, pressure responsive control valve 120 controls the admission and exhaustion of air from within the outer casing.

In operation, commencing with an initial low water pressure or no-pressure condition within the house 102, upon connecting the pump motor to an electric supply, atmospheric air pressure in the system will enable pump motor relay to close, thereby energizing the pump. At the dam, the initial absence of pressurized air in the line 115 therethrough under gravity, to the pump, which pumps is to tank 108.

Water rising within the tank 108 compresses the air in the tank, also charging the line 115. When the pressure reaches a pre-set value it is sufficient to actuate the shut-off valve 120, admitting air to the casing 117 and closing down the hose 118, to terminate the water supply.

Meanwhile, the motor continues driving the pump 106 for a predetermined short delay period, thereby draining down the pipeline 104, so that the permanent air charge therein compresses the water line portion of the pipeline, to dewater it.

As water is used within the house 102 the pressure within the tank 108 drops until a cut-in point is reached. When this happens, the air pressure having dropped to the pre-set level, the shut-off control valve 120 is actuated by its spring to an open position, to release the air from the valve 116, so that the pipeline fills with water, and the water flows to the house; also, the pump motor is energized and commences re-filling the tank with water. During the re-filling process the air-recuperator valve 110 induces air into the tank 108, as make-up for the air loss to the system from operation of the valve 116.

Figure 10:
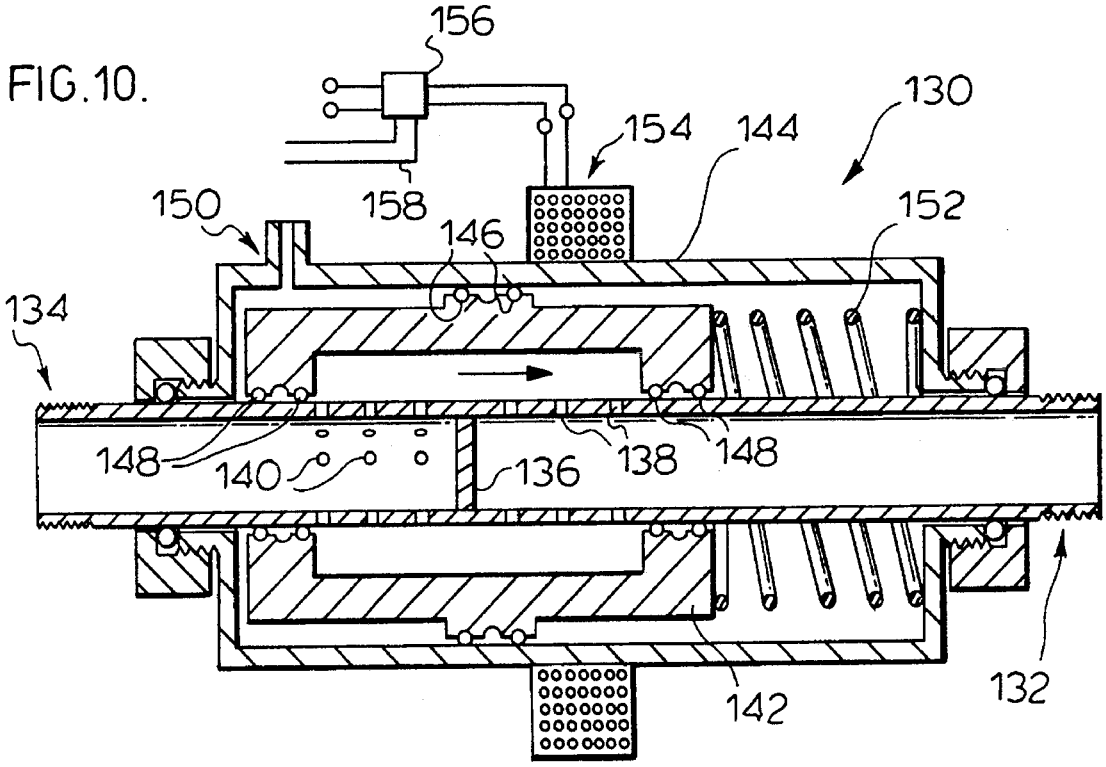
FIG. 10 is a side view in diametrical section of a pneumatically actuated water flow on/off valve, in accordance with the invention.

Referring to FIG. 10, the on/off water control valve 130 has a water inlet portion 132 and a water outlet portion 134 in axially extending relation therewith. A sealing bulkhead portion 136 precludes direct flow between the portions 132, 134.

A series of flow apertures 138 on the inlet side, and apertures 140 on the outlet side permit the passage of water between inlet and outlet of the valve 130.

The outlet apertures 140 are illustrated as being located in the upper half of the valve 130, to facilitate the drainage of water from the valve outlet side upon shut-down.

A spool 142 sealingly mounted within an outer housing 144 by way of sealing O-rings 146 is also sealed by O-rings 148 about the flow portions 132, 134. The spool 142 is illustrated in its "on" position, being axially movable from the position shown, in a rightward direction to its "off" position, so as to seal off and isolate the outlet apertures 140, thereby shutting down the valve. Displacement of the spool 142 may be effected by way of a change in air pressure, applied at air inlet 150. An alternative is the use of a bellows or diaphragm-type actuator, which has been found to be effective for the purpose, and can operate on the comparatively small air pressure difference generated by the hydraulic "bump" and associated pneumatic pulse generated by the pneumatic sensor 54, referred to above.

A spool return spring 152 and also a return solenoid 154 are illustrated for the sake of completeness, either of which can provide the required repositioning of the spool 142 to the "on" position. A master relay 156 enables the use of a low voltage input at terminals 158 to control the solenoid 154, in valve operating relation with the valve 130.

Figure 11:
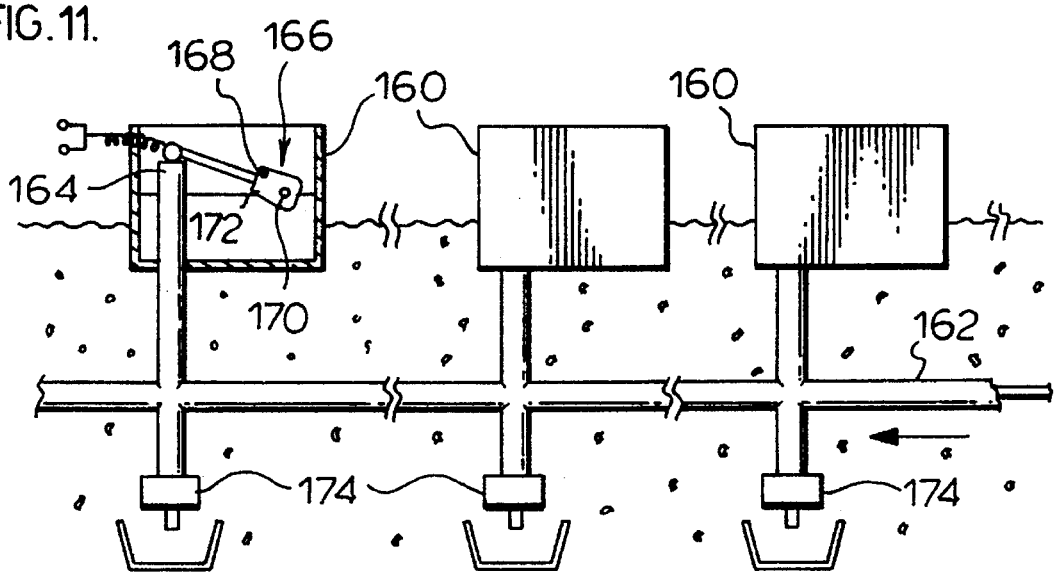
FIG. 11 is a schematic side view of a water supply embodiment for use in supplying one or a number of drinking troughs; and, FIG. 12 shows a weight or demand-actuated air bladder pump.

Turning to FIG. 11, a series of drinking bowls 160 are shown connected in serial relation with a gas-charged frost-free water line 162. The water bowls 160 may be in the open, having the water supply line 162 buried deep, sensibly below the frost line.

In addition to the usual float valve 164, for controlling the inlet of water, the system may also incorporate a low voltage electric switch 166, illustrated as being contained within the valve float 168. This switch 166 comprises a conductive ball 170 rolling along a track 172, and in the "float-lowered" position illustrated, completing the circuit to energize the relay 156, of FIG. 10.

A plurality of drain valves 174 serve to drain the frost-free line 162 at the conclusion of pumping. It will be understood that the troughs 160 may be in widely spaced relation, hence generally requiring the provision of a plurality of line drain valves 174. The drain valves 174 are pressure sensitive, to drain the line 162 at the cessation of pumping. The valves 174 are illustrated as being located in drain pits.

Figure 12:
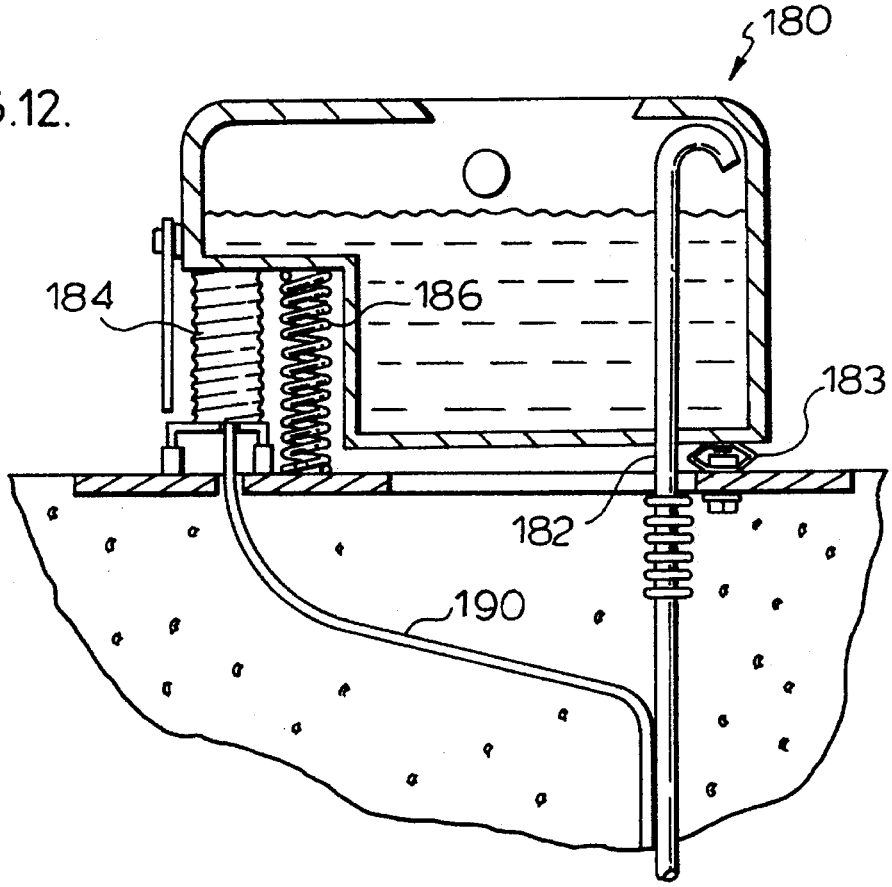

Referring to FIG. 12, an animal watering trough 180 is shown, having a flexible water inlet 182, located adjacent or in line with flexible pivot mounts 183. A bellows 184, serving as an air pump and acting as a load sensor is located adjacent a coil spring support 186. The trough pivots about its mounts 183, serving to compress the bellows 182 when the trough is filled, to pump air into hose 190.

The connector hose 190 may connect with a pump control relay, (now shown), so as to switch on and/or switch off the pump, the pump generally being the water supply pump for the system. However, it might also be an air pump for operating the frost-free hose in a de-watering mode or for operating it as a water pump, or a pump for other fluids.

The connector hose 190 may also be connected in controlling relation with a water flow control valve similar to the FIG. 10 embodiment, wherein increased air pressure closes the water valve.

The resiliently supported deflecting tank 180, or the deforming air bladder-pump 184 may also serve to control an electric attitude switch, such as the switch 166 illustrated in FIG. 11, for the purpose of providing an additional or alternative supply-sensitive control function to the system.

In the case of a number of animal watering troughs, these may be connected in parallel relation to a common air hose 190, each trough air pump having sufficient air displacement, when compressed by its respective tank or trough, to individually operate the related supply device, be it pump relay or flow control valve.

It is contemplated that the bottom of the watering trough may contact a pressure responsive electrical contact strip, to provide an on/off pressure responsive electrical control for the system.

What I claim by Letters Patent of the United States is:

1. A liquid supply system for operation in a freezing environment, and having receiver means; substantially non-freezing liquid supply means operable to displace liquid within the system to said remotely located receiver means; a drainable pipeline traversing an environment subject to freezing, and connecting said supply means with said receiver means; and a pressure responsive device having a resilient walled compartment containing non-freezing fluid therein, said device being responsive to changes in demand for liquid at said receiver means, and connected through said freezing environment in controlling relation with said liquid supply means, in use to regulate said liquid supply means when demand for liquid changes at said receiver means; and said system pipeline including drain valve means permitting drainage of liquid from said drainable pipeline when the demand for liquid at said receiver means is fulfilled.

2. The system as set forth in claim 1, said system including system control means; gas passage means connecting said pressure responsive device with said system control means, whereby in use a predetermined change in the pressure of said liquid sensed by said pressure responsive device controls the operation of said system.

3. The system as set forth in claim 2, said liquid supply means including a pump; said system control means comprising pump control switch means, whereby in use said predetermined change in sensed liquid pressure controls the operation of said pump.

4. The system as set forth in claim 3, said receiver means including trough means having a controlled inlet water supply therefor connect to said pipeline and supplied by way of said pump.

5. The system as set forth in claim 1, including hose attachment means having a first, serrated outer end to receive a first hose in inserted relation therethrough, and a second larger hose in attached, overlying relation with said serrated end; and a hollow tubular insert within the other end of said attachment means, inserted in jamming, sealing relation within the adjoining end of said first hose, to hold an outer surface portion of said first hose in sealing relation against an inner surface portion of said attachment means.

6. The system as set forth in claim 5, including retainer bushing means secured within said other end in jamming relation with said tubular insert, to preclude the withdrawal thereof from said other end.

7. The system as set forth in claim 1, including drip-valve means connected with said pipeline in liquid draining relation therewith, said drip-valve providing a slow rate leak from said system, so as to diminish the pressure of liquid within the pipeline on cessation of pumping.

8. The system as set forth in claim 1, said liquid supply means having a resilient walled passage compressible, in use, by the application of air pressure through said gas passage means to substantially preclude the passage of liquid to said pipeline.

9. The system as set forth in claim 8, said liquid supply means being located in liquid admitting, flow-controlling relation with said pipeline.

10. The system as set forth in claim 9, said pressure responsive device being connected to said liquid supply means, to form a source of air compressed by water displaced in said system.

11. The system as set forth in claim 1, having a water providing container subject to changes in the weight thereof in accordance with the quantity of water present therein; said container being in load applying relation with said pressure responsive device, to generate air pressure therein responsive to the water contents of said container.

12. A liquid supply system having liquid supply means operable to displace liquid within the system; a drainable pipeline connected thereto; and a pressure responsive device having a resilent walled fluid-containing compartment therein responsive to changes in demand for liquid within the system, and connected in controlling relation with said liquid supply means, to operate said supply means when demand for liquid exists within the system; said system permitting drainage of liquid from the system pipeline when the demand for liquid within the system is fulfilled; said receiver means including hose attachment means comprising a hollow cylindrical body having a central through passage, a first end having a first portion of reduced outer diameter, the outer surface thereof being serrated by a plurality of circumferential tooth-shaped projecting ribs, to engage an inner surface portion of an end of a first hose when applied thereto, and an adjacent second portion of said body of greater diameter, with a serrated outer surface to receive a second hose thereon, said second hose engaging an adjoining outer surface portion of said first hose end in radial compressive relation therewith.

13. The system as set forth in claim 12, said hollow body having a second end thereof with a threaded outer surface, for attachment to an adjoining portion of the system, in sealing relation thereto.

14. A water supply system including a pipeline having a flexible hose portion for the transfer of water therethrough, and valve means to control the passage of water in the pipeline, having air-pressure responsive means to actuate the valve in flow blocking operation thereof; and air pressurizing means in said system connected in controlling relation with said valve means.

15. The system as set forth in claim 14, said valve means comprising a central passage for the transfer of water therethrough; passage blocking means to preclude the direct passage of water through said central passage; flow control means adjacent said passage, to control the passage of water about said blocking means, and valve control means in controlling relation with said flow control means, to operate said valve to an open and to a closed position.

16. The system as set forth in claim 15, said valve control means being air pressure responsive, to operate said valve to a said position.

17. The system as set forth in claim 14, including a water trough having a float valve connected to said pipeline, to control the ingress of water to the trough; and drain means connected to said pipeline, to drain water therefrom upon cessation of the application of pumping pressure to the pipeline.

18. The system as set forth in claim 17, and float actuated, low voltage electric switch means connected in controlling relation with said water supply.

19. The system as set forth in claim 18, said electric switch means controlling a switching relay connected in energizing relation with said water supply.

* * * * *